United States Patent [19]

Lemkin

[11] 4,107,768

[45] Aug. 15, 1978

[54] GLOBE FOR LIGHTBULBS

[75] Inventor: Jack L. Lemkin, Cincinnati, Ohio

[73] Assignee: Midland-Ross Corporation, Cleveland, Ohio

[21] Appl. No.: 760,126

[22] Filed: Jan. 17, 1977

[51] Int. Cl.[2] ..... F21V 3/00

[52] U.S. Cl. ..... 362/363; 362/373

[58] Field of Search ..... 240/100, 151; 362/363, 362/368, 373, 326, 329, 455

[56] References Cited

U.S. PATENT DOCUMENTS

| | | | |
|---|---|---|---|
| 2,122,295 | 6/1938 | Rolpn | 240/93 |
| 2,293,116 | 8/1942 | Claspy | 240/78 |
| 2,614,207 | 10/1952 | Smith | 240/100 |
| 2,739,224 | 3/1956 | Knapp | 240/100 |
| 2,999,923 | 9/1961 | Schmidt | 240/151 |
| 3,196,269 | 7/1965 | McDermott | 240/151 |
| 3,351,751 | 11/1967 | Stube | 240/100 |

*Primary Examiner*—Verlin R. Pendegrass
*Assistant Examiner*—Donald P. Walsh
*Attorney, Agent, or Firm*—H. Duane Switzer

[57] ABSTRACT

A globe for an incandescent lightbulb includes a pair of parts bonded to opposite edges of a heat dissipating metal ring.

14 Claims, 1 Drawing Figure

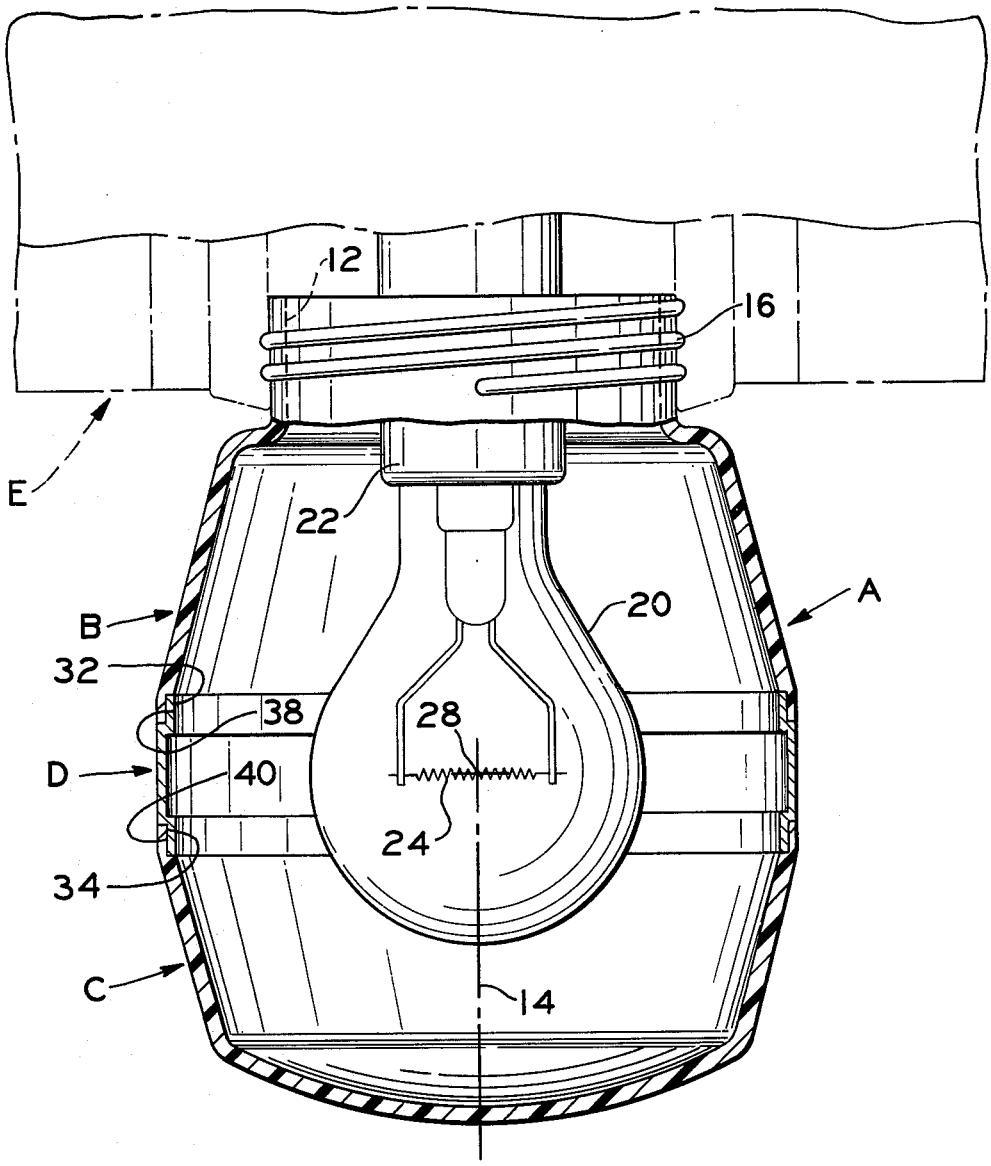
12
16
E
22
20
A
B
32
38
28
D
40
24
34
C
14

GLOBE FOR LIGHTBULBS

BACKGROUND OF THE INVENTION

This application relates to the art of lighting and, more particularly, to globes for protecting incandescent lightbulbs.

Incandescent lightbulbs are commonly surrounded by a glass globe for protecting the bulb and diffusing the light therefrom. In areas where the glass globe is subject to frequent breakage, it is surrounded by a metal cage. An arrangement of this type requiring a glass globe and a metal cage for protecting the lightbulb is very expensive and the glass globe is still subject to breakage when smaller objects penetrate the metal cage. The metal cage also reduces the illumination from the bulb.

Relatively inexpensive globes having a high resistance to breakage have been proposed of synthetic plastic material. Thermoplastics are particularly suitable for an application of this type due to the ease of molding, low cost, resistance to breakage and light transmitting properties. However, thermoplastics are generally incapable of withstanding high temperatures and the wattage bulbs usable with thermoplastic globes have been limited.

It would be desirable to have a thermoplastic globe which could be used with high wattage incandescent bulbs without deterioration or softening of the globe.

SUMMARY OF THE INVENTION

A globe for an incandescent lightbulb includes opposed plastic parts bonded to a heat dissipating metal ring.

In a preferred arrangement, the globe is of the type having an opening at one end for freely receiving an incandescent bulb therethrough. The globe has a closed opposite end and includes a longitudinal axis extending between the opening and the closed end. The metal ring surrounds the axis centrally, and is located intermediate the opening and the closed end of the globe.

In a preferred arrangement, the globe is constructed for cooperation with incandescent lightbulbs in such a manner that the bulb filament is aligned with the metal ring transversely of the globe longitudinal axis. The bulb filament intersects the globe axis at an intersection, and the metal ring lies closer to this intersection than any portion of the plastic parts. With this arrangement, the metal ring receives a substantial amount of heat from the bulb without severely reducing the illumination provided thereby.

The globe preferably includes integral mounting means surrounding the opening for mounting the globe to a fixture in surrounding relationship to an incandescent lightbulb mounted in the fixture.

The metal ring is preferably black to enhance its heat dissipating properties. In addition, the metal ring is preferably arranged so that its inner surface exposed to the inner surface of the globe has an area at least as great as the outer surface of the metal ring exposed at the outer surface of the globe.

In one arrangement, the metal ring and the plastic parts have cooperating interdigitated rabbets. The plastic parts are bonded to the metal ring as by ultrasonic welding or the use of adhesive. The parts are inseparably bonded together and access to the interior of the globe for replacement of the incandescent bulb is only through the opening in the globe.

In one arrangement, the wall thickness of the plastic parts is substantially greater than the wall thickness of the metal ring. The metal ring has its opposite end portions inwardly offset to define outer rabbets, and the plastic parts have inwardly facing rabbets for cooperation with the rabbets on the metal ring.

The plastic parts may be of any suitable synthetic plastic material and in a preferred arrangement are of a polycarbonate. In addition to heat fusing or ultrasonic welding of the plastic parts to the metal ring, suitable thermosetting resin adhesive such as epoxy or cyanoacrylate can be used.

The plastic parts preferably extend parallel to the longitudinal axis of the globe over a distance greater than the width of the metal ring parallel to that axis. This provides substantially uninhibited illumination while offering good heat dissipating characteristics.

BRIEF DESCRIPTION OF THE DRAWING

The drawing shows a cross-sectional elevational view of a globe constructed in accordance with the present invention.

DESCRIPTION OF A PREFERRED EMBODIMENT

With reference to the drawing, a lightbulb globe A includes a circular opening 12 at one end and a closed opposite end, and has a central longitudinal axis 14 extending between its opposite ends. Longitudinal axis 14 is coincidental with the center of circular opening 12.

Globe A includes opposite parts B and C bonded to a heat dissipating metal ring D. Parts B and C are molded of synthetic plastic material and preferably a thermoplastic such as polycarbonate or the like. The plastic material has a heat deflection point not greater than around 300° F. Parts B and C may be bonded to ring D ultrasonically or by use of a thermosetting resin adhesive such as epoxy or cyanoacrylate. The bond between parts B and C and ring D is preferably one which inseparably secures the parts to the ring.

Globe A is provided with mounting means surrounding opening 12 for mounting same to a fixture as shown at E. The mounting means may take many forms and in the arrangement shown comprises external threads 16 molded on a cylindrical neck around opening 12. Light fixture E has a cooperating internally threaded socket for receiving threads 16. Globe A is positioned in surrounding relationship to a conventional incandescent lightbulb 20 shown as being of the bulbous type and having a threaded end receivable in a threaded socket 22 on fixture E. Incandescent lightbulb 20 includes a filament 24 which intersects axis 14 at an intersection 28, and filament 24 is aligned with ring D transversely of longitudinal axis 14.

In one arrangement, metal ring D has a material thickness which is approximately one half the wall thickness of parts B and C. Ring D may be formed of any suitable material having high heat transfer properties. In a preferred arrangement, ring D is made of aluminum which is preferably black so it will absorb considerable heat internally of globe A.

Parts B and C are internally circumferentially rabbeted as at 32 and 34 for interdigitating cooperation with external circumferential rabbets 38 and 40 on metal ring D. The rabbets are dimensioned and shaped for cooperation with one another. Where adhesive is used for bonding the parts, it is spread on the surfaces to be joined before they are placed together. Where ultrasonic welding is used, a suitable fixture may be provided to hold the parts in assembled relationship while they are fused together. External rabbets 38 and 40 on metal ring D are formed by deforming the opposite end portions of ring D inwardly a distance approximately equal to the material thickness of ring D. With an arrangement of the type described, the external surface of ring D is substantially flush with the external surface of parts B and C.

In a preferred arrangement, the internal surface area of ring D exposed to the interior of globe A is at least as great as the external surface area thereof on the outside of globe A. In the preferred arrangement shown, the internal surface area of ring D is greater than the external area thereof. Parts B and C are provided with cylindrical portions where rabbets 32 and 34 are formed, and ring D is cylindrical so that it essentially blocks only horizontal light rays from bulb 20. Parts B and C extend over a distance parallel to longitudinal axis 14 which is greater than the width of metal ring D along axis 14. Therefore, a substantial portion of the light form bulb 20 is transmitted through light transmitting parts B and C. Light transmitting parts B and C may be tinted somewhat or molded with light diffusing patterns. Obviously, parts B and C may also be a clear polycarbonate or the like. In the preferred shape of globe A, the internal surface of ring D is closer to intersection 28 than any portions of parts B and C. Therefore, ring D will transmit a substantial portion of the heat from the interior of globe A to the exterior thereof. Opening 12 is dimensioned for freely receiving bulb 20 therethrough, and removal of globe A from fixture E is the only way of replacing bulb 20. Longitudinal axis 14 is coincidental with the center of ring D and intersection 28 is preferably located approximately at the midpoint of ring D. Parts B and C are inseparably bonded to the opposite circumferential edges of ring D. The arrangement shown and described in this application permits the use of high wattage bulbs 20 inside the globe A without heating parts B and C of globe A to their heat distortion point because a substantial amount of heat is dissipated through metal ring D.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A globe for a bulbous-type incandescent lightbulb having a longitudinal bulb axis, said globe having an opening at one end sized for freely receiving the lightbulb therethrough while the lightbulb is mounted in an electrical socket by moving said globe axially with said opening therein aligned with the lightbulb so the lightbulb passes through said opening for positioning said globe in surrounding relationship to the lightbulb, said globe including a closed end opposite from said opening and having a central longitudinal globe axis extending between said opening and closed end, said globe axis being substantially coincidental with said bulb axis, said globe including opposite parts of light transmitting synthetic plastic material inseparably bonded in spaced relationship to opposite edges of a heat dissipating metal ring surrounding said globe axis in radially-spaced relationship thereto and having a ring axis substantially coincidental with said globe axis and with said bulb axis, said globe being sized and positioned relative to the lightbulb such that said parts of plastic material would normally melt from heat produced by the lightbulb but being maintained at a temperature below melting by dissipation of heat from the lightbulb and globe through said ring, and said parts being inseparably bonded to said ring in the sense of being bonded thereto by such procedures as heat fusion, ultrasonic welding, or adhesive or the like as opposed to being joined by mechanical fasteners or a joint which is readily disassembled or separated.

2. The globe of claim 1 wherein said ring has a greater surface area exposed to the interior of said globe than to the exterior thereof.

3. The globe of claim 1 wherein said globe is positionable in surrounding relationship to an incandescent lightbulb having a filament aligned with said ring transversely of said axis.

4. The globe of claim 1 wherein said ring is black.

5. The globe of claim 1 wherein said ring and said parts have cooperating rabbeted edges.

6. The globe of claim 1 wherein each said part extends outwardly from said ring over a distance parallel to said axis which is greater than the width of said ring parallel to said axis.

7. The globe of claim 1 wherein said ring has an inner surface exposed to the inner surface of said globe which is at least as great as the outer surface thereof exposed at the outer surface of said globe.

8. The globe of claim 1 including integral mounting means surrounding said opening for mounting said globe to a fixture.

9. The globe of claim 1 including an incandescent lightbulb received therein through said opening and having a filament intersecting said axis at an intesection, and said ring being closer to said intersection than any portion of said parts.

10. The globe of claim 1 wherein said parts are of thermoplastic material.

11. The globe of claim 1 wherein said parts have a wall thickness substantially greater than said ring.

12. The globe of claim 11 wherein said parts have internally rabbeted circumferential edges and said ring has inwardly offset opposite end portions to define outwardly facing ring rabbets interdigitated with said internally rabbeted circumferential edges of said parts.

13. A globe for lightbulbs including opposite parts of light transmitting thermoplastic material inseparably bonded in spaced relationship to opposite edges of a circumferentially continuous heat dissipating metal ring, and an opening in said globe spaced from said ring for passing said globe over an incandescent lightbulb and positioning same in surrounding relationship to the incandescent lightbulb with the longitudinal axes of the bulb, globe and ring substantially coincidental, said parts and ring being inseparably bonded together in the sense of being bonded together by heat fusion, ultrasonic welding or adhesive as opposed to being joined by mechanical fasteners or a joint which is readily disassembled or separated.

14. The globe of claim 13 wherein said opening and ring surround a common central axis.

* * * * *